US010328451B2

(12) United States Patent
Kang

(10) Patent No.: US 10,328,451 B2
(45) Date of Patent: Jun. 25, 2019

(54) GEL-STATE CONTENT DISCHARGING APPLICATOR

(71) Applicant: Sungil Kang, Seongnam-si (KR)

(72) Inventor: Sungil Kang, Seongnam-si (KR)

( * ) Notice: Subject to any disclaimer, the term of this patent is extended or adjusted under 35 U.S.C. 154(b) by 190 days.

(21) Appl. No.: 15/529,224

(22) PCT Filed: Dec. 1, 2015

(86) PCT No.: PCT/KR2015/012956

§ 371 (c)(1),
(2) Date: May 24, 2017

(87) PCT Pub. No.: WO2016/089072

PCT Pub. Date: Jun. 9, 2016

(65) Prior Publication Data

US 2017/0326578 A1 Nov. 16, 2017

(30) Foreign Application Priority Data

Dec. 3, 2014 (KR) ..... 20-2014-0008861 U

(51) Int. Cl.

| | |
|---|---|
| ***B05B 11/02*** | (2006.01) |
| ***B05C 17/005*** | (2006.01) |
| ***B65D 77/04*** | (2006.01) |
| ***B65D 83/00*** | (2006.01) |
| ***B43K 5/18*** | (2006.01) |
| ***B43M 11/06*** | (2006.01) |
| ***B05B 11/00*** | (2006.01) |

(52) U.S. Cl.

CPC ..... *B05C 17/005* (2013.01); *B05B 11/0035* (2013.01); *B05B 11/0089* (2013.01); *B05B 11/3032* (2013.01); *B05B 11/3033* (2013.01); *B05B 11/3052* (2013.01); *B43K 5/1845* (2013.01); *B43M 11/06* (2013.01); *B65D 77/04* (2013.01); *B65D 83/00* (2013.01); *B05B 11/0038* (2018.08); *B05B 11/00416* (2018.08)

(58) Field of Classification Search

CPC ..... B05B 11/02; B05B 11/30; B65D 83/0005; B65D 83/0033

USPC ..... 401/141, 188 R

See application file for complete search history.

(56) References Cited

FOREIGN PATENT DOCUMENTS

| | | | |
|---|---|---|---|
| JP | 2010-235201 | A | 10/2010 |
| KR | 10-2014-0041739 | A | 4/2014 |

(Continued)

*Primary Examiner* — David J Walczak
*Assistant Examiner* — Joshua R Wiljanen
(74) *Attorney, Agent, or Firm* — Heedong Chae; Lucem, PC

(57) ABSTRACT

The present invention relates to a gel-state content discharging applicator and, more particularly, to a gel-state content, discharging applicator wherein a pressurization button is formed on the lower end of a container such that, when the pressurization button is pressed, an inner container is pressurized, thereby pressurizing an inner container cap, which is coupled to the inner container, and a pump, which is coupled to the inner container cap; as a result, the gel-state content is discharged through a valve of the pump and through a discharge member such that a predetermined mount of gel-state content is always discharged easily; in addition, formation of the pressurization button on the lower end of the container guarantees that, when the container according to the present invention is used for tooth-related products among medications and sanitary aids, the content can be easily applied even to molar parts.

12 Claims, 7 Drawing Sheets

(56) References Cited

FOREIGN PATENT DOCUMENTS

| | | | |
|---|---|---|---|
| KR | 10-1390993 | B1 | 5/2014 |
| KR | 10-2014-0091433 | A | 7/2014 |
| KR | 10-2014-0122494 | A | 10/2014 |

GEL-STATE CONTENT DISCHARGING APPLICATOR

CROSS-REFERENCE TO RELATED APPLICATION

This application claims the benefit of Korean application No. 20-2014-0008861, filed on Dec. 3, 2014 with the Korean Intellectual Property Office, the disclosure of which is incorporated herein by reference.

TECHNICAL FIELD

The present invention relates to a gel-state content discharging applicator and, more particularly, to a gel-state content discharging applicator wherein a pressurization button is formed on the lower end of a container such that, when the pressurization button is pressed, an inner container is pressurized, thereby pressurizing an inner container cap, which is coupled to the inner container, and a pump, which is coupled to the inner container cap; as a result, the gel-state content is discharged through a valve of the pump and through a discharge member such that a predetermined mount of gel-state content is always discharged easily; in addition, formation of the pressurization button on the lower end of the container guarantees that, when the container according to the present invention is used for tooth-related products among medications and sanitary aids, the content can be easily applied even to molar parts.

BACKGROUND ART

In general, cosmetics, or medicines and sanitary aids are often prepared in a gel-state form to allow the contents to be effectively absorbed for a long time after being applied to an application portion.

When the gel-state contents filled into a glass container or a tube container is used, a user has used the gel-state in such a manner that the gel-state contents are hand-held or squeezed from the tube container and then, the gel-state contents are applied with a tool such as a puff or a cotton swab, or a hand.

However, when the gel-state contents are applied with a tool such as a puff or a cotton swab as the related art, since the gel contents are stuck on the puff or cotton swab, the gel-state contents are wasted. When the user applies the gel-state contents with his hands, the contents of the gel are stuck on the hands every time that the gel-state contents are used, which is inconvenient in use since the hands must be washed each time. As described above, the hands on which the gel-state contents are stuck are washed so that the gel-state contents are lost.

To solve the problems, described above, as shown in FIG. 1, a product has been disclosed in Korean Registered Utility Model No. 20-0433672 issued to the applicant of the present application, where, when the user presses a side button provided outside a rubber pump formed of rubber, the rubber pump is pressed to discharge the gel-state contents filled in a container by the pressure, and since an application member is formed outside an outlet, any tools are not required and the gel-state contents may be used easily without being stuck on user's hands.

However, according to the related art described above, when the side button is pressed, the central portion of the rubber pump having a jar shape is pressed. In this case, since only the central portion of the rubber pump is pressed, the unpressurized portion of the rubber pump swells up, so that it is impossible to discharge the constant amount of contents. Thus, it is difficult to control the amount of contents to be discharged because the discharge amount of the contents is changed each time when the rubber pump is pressed.

In addition, according to the related art, since the side button is formed on an outside of an upper end of the container, when the container is used for tooth-related products among medications and sanitary aids, the side button is inserted into the mouth when applying the gel-state contents to the molar part, so that it is inconvenient to push the side button to discharge the contents.

DISCLOSURE

Technical Problem

To solve the problems described above, an object of the present invention is to provide a gel-state content discharging applicator, wherein a pressurization button is formed on the lower end of a container such that, when the pressurization button is pressed, an inner container is pressurized, thereby pressurizing an inner container cap, which is coupled to the inner container, and a pump, which, is coupled to the inner container cap, as a result, the gel-state content is discharged through a valve of the pump and through a discharge member such that a predetermined amount of gel-state content is always discharged easily.

In addition, another object of the present invention is to provide a gel-state content discharging applicator, in which a pressurization button is formed on a lower end of a container, such that the contents may be easily applied even to molar parts when a container according to the present invention is used for tooth-related products among medications and sanitary aids.

Technical Solution

According to the present invention, there is provided a gel-state content discharging applicator which includes: a container (10) including an inner container (11) having a content containing space (14) formed at an inside thereof and an outer container (12) formed outside the inner container (11);

a pressurization button (20) coupled to a lower end of the inner container (11) to move up and down within the outer container (12) together with the inner container (11);

a push plate (50) formed inside the content container (11);

an inner container cap (30) coupled to an upper side of the inner container (11) and formed on an upper portion thereof with a content suction hole (33);

a pump (40) installed on an upper portion of the inner container cap (30);

an outer container cap (60) coupled to an upper portion of the pump (40) and coupled to an upper side of the outer container (12); and a discharge member (70) coupled to an upper side of the outer container cap (60) and formed on an end thereof with a discharge port (71), wherein the pump (40) includes a pump bottom plate (41), a pump main body (42) integrally extending from, an upper side of the pump bottom plate (41), a valve body (43) coupled to an upper portion of the pump main body (42), and an elastic member (44) installed to an outside of the pump main body (42).

In addition, a middle container (13) may be further coupled between the inner container (11) and the outer container (12), and may be tightly fitted with the outer container (12), The middle container (13) may include an upper container (131) formed at upper side and a lower container (132) formed at a lower side and coupled to the upper container (131).

In addition, an outer container sill (121) and a lower container sill (135) are formed on lower ends of the outer container (12) and the lower container (132), respectively to prevent the pressurization button (20) from being separated.

In addition, the inner container cap (30) includes an inner wall (31) extending downwardly, an outer wall (32) spaced apart from the inner wall (31) by a predetermined interval, a content suction hole (33) formed at the upper center, a pump receiving groove (34) formed on an outside of the content suction hole (33) and an upper wall (35) extending upward from an outside of the pump receiving groove (34).

In addition, a suction valve (411) for selectively blocking the content suction hole (33) of the inner container cap (30) is formed at a center of a lower surface of the pump bottom plate (41), a pump receiving protrusion (412) inserted into the pump receiving groove (34) is formed at an outside of the suction valve (411), and a pump bottom plate horizontal extending piece (413) extends from an outside of the pump receiving protrusion (412).

In addition, the pump main body (42) is integrally formed on an upper portion of the pump bottom plate (41), and includes an elastic support (421) formed of an elastic material in a cylindrical shape and a valve (422) formed of an elastic material and extending upward from the elastic support (421), an upper extension piece (423) formed outside the valve (422) while being spaced apart from the valve (422) by a predetermined interval, and a pump body horizontal extension piece (424) extending horizontally from an end of the upper extension piece (423).

In addition, the valve body (43) includes a lower extension protrusion wheel (431) fitted between the valve (422) and the upper extension piece (423), a blocking plate (432) protruding toward a central low side thereof, a plurality of content discharge holes (433) formed on an outer peripheral surface of the blocking plate (432), and an upper extension protrusion wheel (434) formed on the lower extension protrusion wheel (431).

In addition, a discharge member coupling protrusion wheel (61) to which a discharge member (70) is coupled is formed at an upper side of the outer container cap (60), a valve body coupling protrusion wheel (62) coupled to the valve body (43) is formed at a lower side of the outer container cap (60), and a cover (63) is formed outside the valve body coupling protrusion wheel (62).

In addition, the discharge member (70) is formed therein with a discharge passage (72), and an upper end of the discharge member (70) is formed in a spherical or hemispherical shape to feel soft touch when rubbing against a skin.

In addition, the gel-state content discharging applicator further includes a lid (80) detachable coupled to the outer container cap (60).

In addition, preferably, the suction valve (411) of the pump bottom plate (41) and the elastic support (421) and the valve (422) of the pump main body (42) are formed of at least one of elastomer, silicone rubber, acrylonitrile-butadiene rubber (NBR), polyethylene (PE) and polypropylene (PP).

Advantageous Effects

According to the gel-state content discharging applicator of the present invention, the pressurization button is formed on the lower end of the container such that, when the pressurization button is pressed, the inner container is pressurized, thereby pressurizing the inner container cap, which is coupled to the inner container, and the pump, which is coupled to the inner container cap, as a result, the gel-state content is discharged through the valve of the pump and through the discharge member such that the predetermined mount of gel-state content is always discharged easily.

In addition, the pressurization button is formed on a lower end of a container, such that, the contents may be easily applied even to molar parts when a container according to the present invention is used for tooth-related products among medications and sanitary aids.

BEST MODE

Mode for Invention

Hereinafter, a gel-state content discharging applicator according to an embodiment of the present invention will be described with reference to accompanying drawings.

Figure 1:
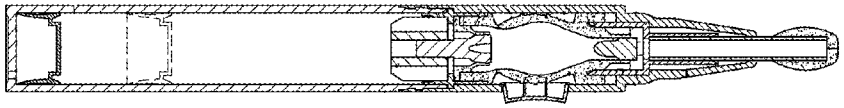
FIG. 1 is a sectional view showing a container for discharging a constant amount of contents according to the related art.
Figure 2:
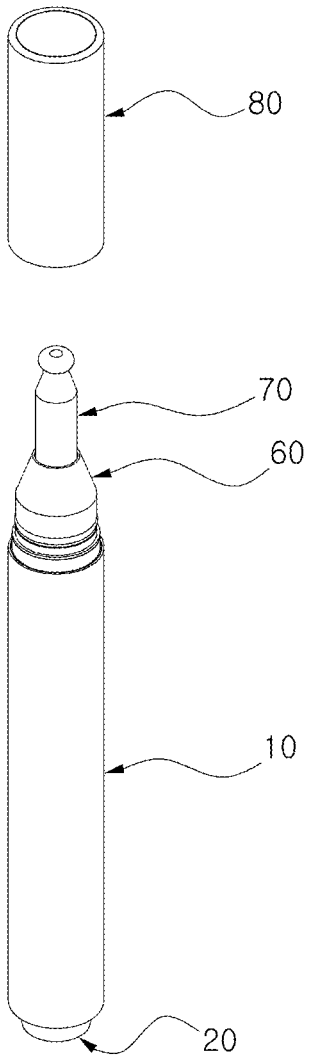
FIG. 2 is a perspective view showing a gel-state content discharging applicator according to the present invention.
Figure 3:
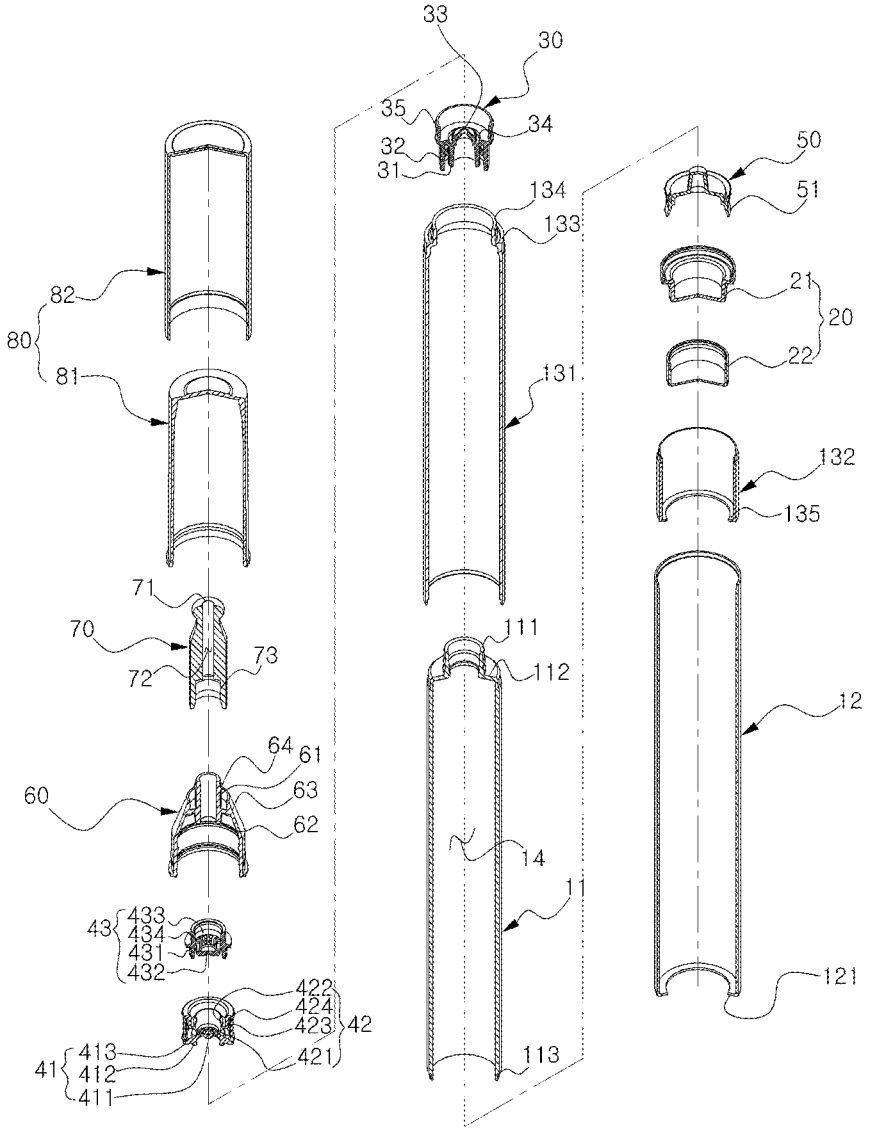
FIG. 3 is an exploded perspective view illustrating a gel-state content discharging applicator according to the present invention.
Figure 4:
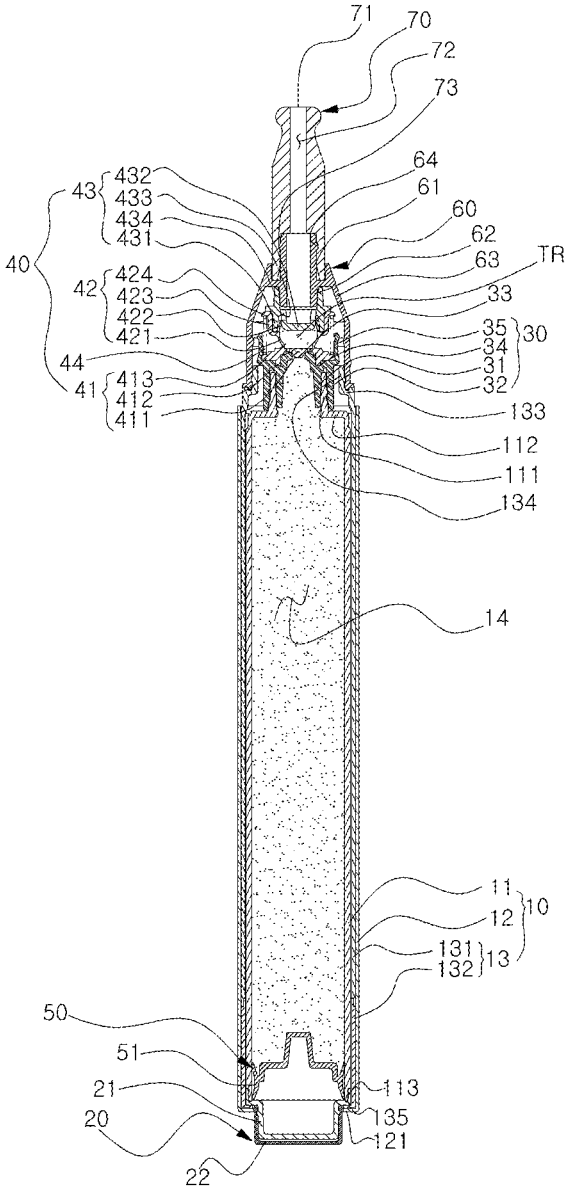
FIG. 4 is a sectional view showing a gel-state content discharging applicator according to the present invention.
Figure 5:
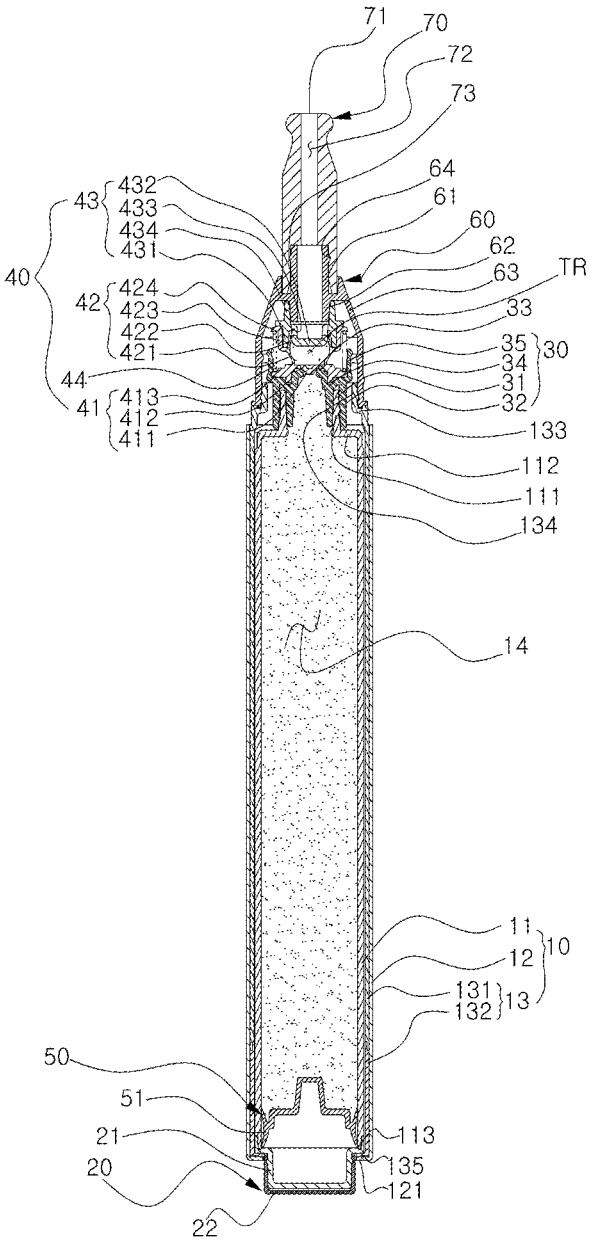
FIG. 5 is a sectional view showing a state in which the gel-state contents are filled in a gel-state content discharging applicator according to the present invention.
Figure 6:
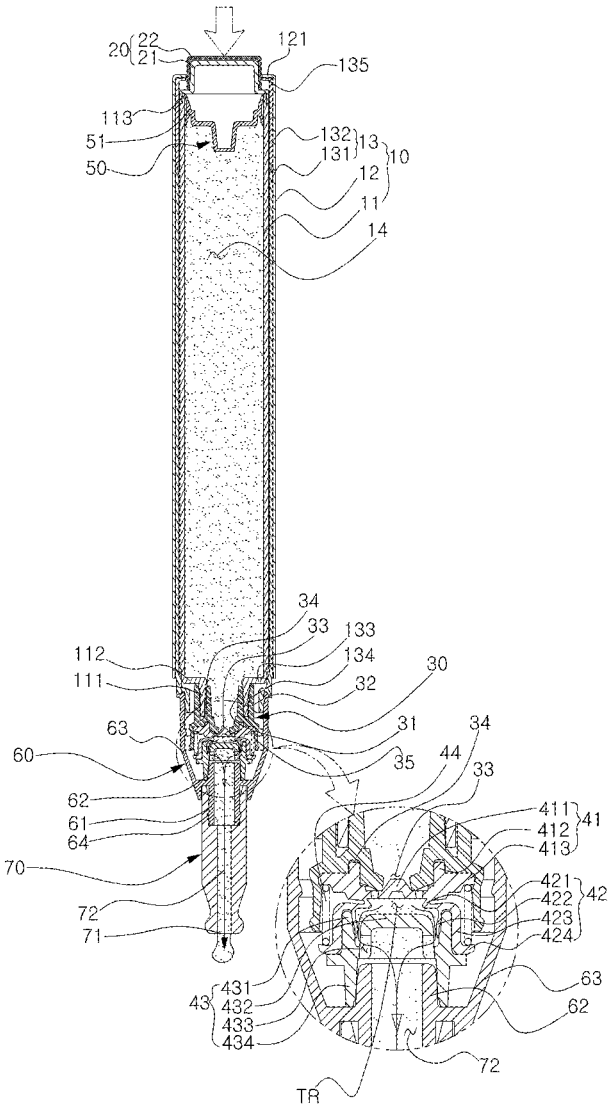
FIG. 6 is a sectional view showing a state in which the gel-state contents are discharged from a gel-state content discharging applicator according to the present invention.
Figure 7:
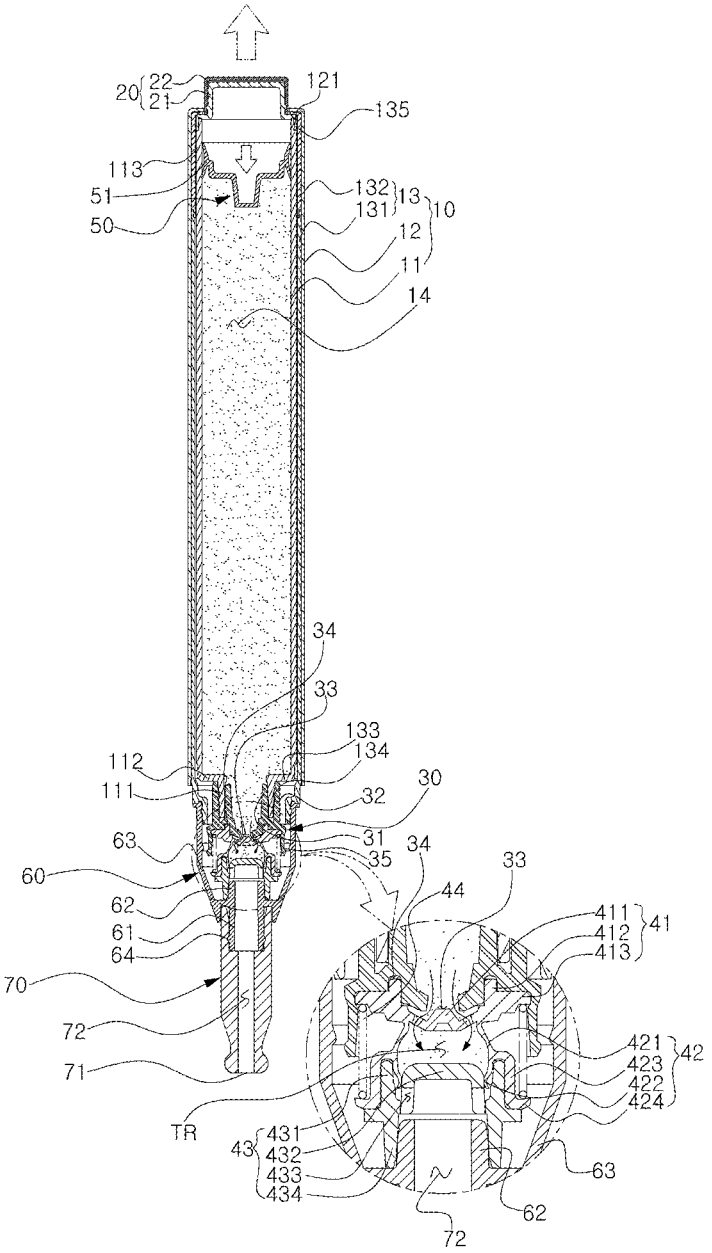
FIG. 7 is a sectional view illustrating a state in which the gel-state contents of a gel-state content discharging applicator according to the present invention are sucked into a content temporary storage space (TR).

FIG. 2 is a perspective view showing a gel-state content discharging applicator according to the present invention. FIG. 3 is an exploded perspective view illustrating a gel-state content discharging applicator according to the present invention. FIG. 4 is a sectional view showing a gel-state content discharging applicator according to the present invention. FIG. 5 is a sectional view showing a state in which the gel-state contents are filled in a gel-state content discharging applicator according to the present invention. FIG. 6 is a sectional view showing a state in which the gel-state contents are discharged from a gel-state content discharging applicator according to the present invention. FIG. 7 is a sectional view illustrating a state in which the gel-state contents of a gel-state content discharging applicator according to the present invention are sucked into a content temporary storage space (TR).

As shown in FIGS. 2 to 4, a gel-state content discharging applicator according to an embodiment of the present invention includes a container 10 including an inner container 11 having a content containing space 14 formed at an inside thereof and an outer container 12 formed outside the inner container 11; a pressurization button 20 coupled to a lower end of the inner container 11 to move up and down within the outer container 12 together with the inner container 11; a push plate 50 formed inside the content container 11; an inner container cap 30 coupled to an upper side of the inner container 11 and formed on an upper portion thereof with a content suction hole 33; a pump 40 installed on an upper portion of the inner container cap 30; an outer container cap 60 coupled to an upper portion of the pump 40 and coupled to an upper side of the outer container 12; and a discharge member 70 coupled to an upper side of the outer container cap 60 and formed on an end thereof with a discharge port 71, where the pump 40 includes a pump bottom plate 41, a pump main body 42 integrally extending from an upper side of the pump bottom plate 41, a valve body 43 coupled to an upper portion of the pump main body 42, and an elastic member 44 installed to an outside of the pump main body 42.

In addition, a middle container 13 may be further coupled between the inner container 11 and the outer container 12 and may be tightly fitted with the outer container 12. The middle container 13 may include an upper container 131 formed at upper side and a lower container 132 formed at a lower side and coupled to the upper container 131.

An inner container inlet part 111 and a middle container inlet 134 are formed on upper ends of the inner container 11 and the middle container 13. An undercut or a thread are formed on outer peripheries of the inner container inlet part 111 and the middle container inlet 134, respectively and are coupled to the inner container cap 30 and the outer container cap 60.

An inner container shoulder 112 and a middle container shoulder 133 are formed on upper portions of the inner container 11 and the middle container 13, respectively. The middle container shoulder 133 is formed to be upwardly spaced apart from the inner container shoulder 112 to secure a space in which the inner container 11 may move up and down inside the middle container 13.

An outer container sill 121 and a lower container sill 135 are formed on lower ends of the outer container 12 and the lower container 132, respectively to prevent the pressurization button 20 from being separated.

At a lower end of the inner container 11, an insertion groove 113 into which an end of the pressurization button 20 is inserted is formed.

The pressurization button 20 includes an inner pressurization button 21 and an outer pressurization button 22 surrounding an outside of the inner pressurization button 21, where an upper end of the inner pressurization button 21 is inserted into the insertion groove 113 of the inner container 11.

The push plate 50 serves to push up the gel-state contents contained in the content receiving space 14 of the inner container 11. A push plate blade 51 is integrally formed on the outer periphery of the push plate 51 and is tightly closed to an inner side surface of the inner container 11.

The inner container cap 30 includes an inner wall 31 extending downwardly, an outer wall 32 spaced apart from the inner wall 31 by a predetermined interval, a content suction hole 33 formed at the upper center, a pump receiving groove 34 formed on an outside of the content suction hole 33 and an upper wall 35 extending upward from an outside of the pump receiving groove 34.

An undercut or a thread is formed on an inner periphery of an outer wall of the inner container cap 30 and is coupled to an outer periphery of the inner container inlet part 111.

The pump 40 includes a pump bottom plate 41, a pump body 42, a valve body 43 and an elastic member 44.

A suction valve 411 for selectively blocking the content suction hole 33 of the inner container cap 30 is formed at a center of a lower surface of the pump bottom plate 41, a pump receiving protrusion 412 inserted into the pump receiving groove 34 is formed at an outside of the suction valve 411, and a pump bottom plate horizontal extending piece 413 extends from an outside of the pump receiving protrusion 412.

The suction valve 411 is formed of a material having good elasticity to allow the suction value 411 to be lifted due to the vacuum pressure of a content temporary storage space TR and to be released when the vacuum pressure is removed. Preferably, the suction valve 411 is formed of at least one of elastomer, silicone rubber, acrylonitrile-butadiene rubber (NBR), polyethylene (PE) and polypropylene (PP).

The pump main body 42 is integrally formed on an upper portion of the pump bottom plate 41, and includes an elastic support 421 formed of an elastic material in a cylindrical shape and a valve 422 formed of an elastic material and extending upward from the elastic support 421, an upper extension piece 423 formed outside the valve 422 while being spaced apart from the valve 422 by a predetermined interval, and a pump body horizontal extension piece 424 extending horizontally from an end of the upper extension piece 423.

The elastic support 421 is repeatedly folded and unfolded by the inner container 11 and the inner content cap 30 which move up and down together with the pressurization button 20 when the pressurization button 20 is pressed, thereby changing the volume of the content temporary storage space TR inside the pump 40. To this end, preferably, the elastic support 421 is formed of at least one of elastomer, silicone rubber, acrylonitrile-butadiene rubber (NBR), polyethylene (PE) and polypropylene (PP).

The valve 422 is closed to or spaced apart from the outer surface of the blocking plate 432 of the valve body 43 to allow the content discharge hole 433 to be selectively opened or closed. To this end, preferably, the value 422 is formed of at least one of elastomer, silicone rubber, acrylonitrile-butadiene rubber (NBR), polyethylene (PE) and polypropylene (PP).

The valve body 43 includes a lower extension protrusion wheel 431 fitted between the valve 422 and the upper extension piece 423, the blocking plate 432 protruding toward a central low side thereof, a plurality of content discharge holes 433 formed on an outer peripheral, surface of the blocking plate 432, and an upper extension protrusion wheel 434 formed on the lower extension protrusion wheel 431.

The elastic member 44 is installed between a pump bottom plate horizontal extension piece 413 of the pump bottom plate 41 and a pump body horizontal extension piece 424 of the pump body 42.

A discharge member coupling protrusion wheel 61 to which a discharge member 70 is coupled is formed at an upper side of the outer container cap 60, a valve body coupling protrusion wheel 62 coupled to the valve body 43 is formed at a lower side of the outer container cap 60, and a cover 63 is formed outside the valve body coupling protrusion wheel 62.

A discharge member coupling protrusion 64 is formed on an outer periphery of the discharge member coupling protrusion wheel 61 and an outer container cap coupling groove 73 is formed at a lower inner side of the discharge member 70, such that the discharge member coupling protrusion 64 and the outer container cap coupling groove 73 are coupled to each other.

The discharge member (70) is formed therein with a discharge passage (72), and an upper end of the discharge member (70) is formed in a spherical or hemispherical shape to feel soft touch when rubbing against a skin.

A lid 80 detachably coupled to the outer container cap 60 may be further formed.

The lid 80 includes an inner lid 81 detachably undercut-coupled to the outer container cap 60 and an outer lid 82 forcibly fitted with an outside of the inner lid 81.

Hereinafter, a method of assembling the gel-state content discharging applicator described above will be described.

First, as shown in FIGS. 3 and 4, the push plate 50 is inserted into the inner container 11. After the pressurization button 20 having the outer push button 22 and the inner push button 21 coupled to each other is coupled to the lower end of the inner container 11, the outer container 12 is fitted from the lower side of the inner container 11.

In a case where the middle container 13 is further coupled, the push plate 50 is inserted into the inner container 11. After pressurization button 20 is installed on the lower end of the inner container 11, the upper container 131 of the middle container 13 is fitted from the upper side of the inner container 11. After the lower container 132 is fitted from the lower side of the inner container 11, the outer container 12 is fitted from the lower side of the inner container 11 while covering the outer container 12 from the lower side of the middle container 13.

Next, the contents are introduced through the inner container inlet part 111, and the inner container cap 30 and the pump 40 are sequentially connected to the upper end of the inner container 11. In detail, the inner container inlet part 111 is inserted into a space between the inner wall 31 and the outer wall 32 of the inner container cap 30. After the pump bottom plate 41 which is integrally formed with the pump main body 42 and of which the elastic member 44 is placed in the pump receiving groove 34 of the inner container cap 30, the lower extension protrusion wheel 431 of the valve body 43 is inserted between the valve 422 and the upper extension piece 423 of the pump main body 42.

While the valve body coupling protrusion wheel 62 of the outer container cap 60 is inserted into the upper extension protrusion wheel 434 of the valve body 43, the outer container cap 60 is coupled to the upper side of the outer container 12.

Finally, the discharge member 70 is coupled to the discharge member coupling protrusion wheel 61 of the outer container cap 60, and then, the lid 80 is coupled to the outer container cap 60.

The operation of the gel-state content discharging applicator described above will be described as follows.

To use the gel-state content discharging applicator, the lid 80 is first separated from the container 10 as shown in FIG. 5 and the pressurization button 20 coupled to the lower side of the container 10 is pressed as shown in FIG. 6.

If the pressurization button 20 is pressed, the inner container 11 and the inner container cap 30 coupled to the inner container 11 are moved together.

The elastic support 421 of the pump main body 42 is folded while the pump bottom plate 41 of the pump 40 is pressed by the movement of the inner container cap 30, and at the same time, the volume of the content temporary storage space TR is reduced. Thus, pressure is generated in the content temporary storage space TR, and the contents in the content temporary storage space TR are to be discharged to an outside due to the pressure, so that a discharge pressure is generated and the suction valve 411 of the pump bottom plate 41 blocks the content suction hole 33.

At the same time, the contents of the contents temporary storage space TR allow the valve 422 of an elastic material tightly closed to the outer surface of the blocking plate 432 of the valve body 43 to be spaced apart from the blocking plate of the valve body 43, so that the discharge hole 433 is opened. After the contents are discharged through the discharge hole 433, the contents are discharged to an outside through the discharge passage 72 and the discharge port 71 of the discharge member 70.

Thereafter, as shown in FIG. 7, when the pressurization of the pressurization button 20 is released, the elasticity of the elastic member 44 and the elastic support 421 allows the pump bottom plate 41, the inner container cap 30, the inner container 11, and the pressurization button 20 to move up, and the volume of the temporary provisional storage space TR is increased while the shape of the elastic support 421 of the pump main body 42 is restored, so that the vacuum pressure is generated.

Therefore, the valve 422 of the pump main body 42 is tightly closed to the blocking plate 432 of the valve body 43 to close the content discharge hole 433 and at the same time, while the suction valve 412 of the pump bottom plate 41 is lifted by the vacuum pressure generated in the content temporary storage space TR, the content suction hole 33 is opened. Thus, the contents contained in the content containing space 14 of the inner container 11 are introduced into the content temporary storage space TR through the content suction holes 33.

As described above, the gel-state content discharging applicator described in the present invention is an illustrative purpose only, and the present invention is not limited thereto. Thus, it should be understood that numerous other modifications and embodiments can be devised by those skilled in the art within the spirit and scope of the present invention and they will fall within the scope of the present invention.

DESCRIPTION OF REFERENCE NUMERAL

10: Container
11: Inner container
12: Outer container
13: Middle container
14: Content containing space
111: Inner container inlet part
112: Inner container shoulder
113: Inserting groove
121: Outer container sill
131: Upper container
132: Lower container
133: Middle container shoulder
134: Middle container inlet
135: Lower container sill
20: Pressurization button
21: Inner pressurization button
22: Outer pressurization button
30: Inner container cap
31: Inner wall
32: Outer wall
33: Content suction hole
34: Pump receiving groove
35: Upper wall
40: Pump
41: Pump bottom plate

42: Pump main body
43: Valve body
44; Elastic member
411: Suction valve
412: Pump receiving protrusion
413: Pump bottom plate horizontal extending piece
421: Elastic support
422: Valve
423: Upper extension piece
424: Pump body horizontal extension piece
431: Lower extension protrusion wheel
432: Blocking plate
433: Content discharge hole
434: tipper extension protrusion wheel
50: Push plate
51: Push plate blade
60: Outer container cap
61: Discharge member coupling protrusion wheel
62: Valve body coupling protrusion wheel
63: Cover
64: Discharge member coupling protrusion
70: Discharge member
71: Discharge port
72: Discharge passage
73: Outer container cap coupling groove
80: Lid
81: Inner lid
82: Outer lid

The invention claimed is:

1. A gel-state content discharging applicator comprising:

a container (10) including an inner container (11) having a content containing space (14) formed at an inside thereof and an outer container (12) formed outside the inner container (11);

a pressurization button (20) coupled to a lower end of the inner container (11) to move up and down within the outer container (12) together with the inner container (11);

a push plate (50) formed inside the content container (11);

an inner container cap (30) coupled to an upper side of the inner container (11) and formed on an upper portion thereof with a content suction hole (33);

a pump (40) installed on an upper portion of the inner container cap (30);

an outer container cap (60) coupled to an upper portion of the pump (40) and coupled to an upper side of the outer container (12); and a discharge member (70) coupled to an upper side of the outer container cap (60) and formed on an end thereof with a discharge port (71), wherein the pump (40) comprises a pump bottom plate (41), a pump main body (42) integrally extending from an upper side of the pump bottom plate (41), a valve body (43) coupled to an upper portion of the pump main body (42), and an elastic member (44) installed to an outside of the pump main body (42), wherein a middle container (13) is coupled between the inner container (11) and the outer container (12), and wherein the middle container (13) includes an upper container (131) formed at an upper side and a lower container (132) formed at a lower side and coupled to the upper container (131).

2. The gel-state content discharging applicator of claim 1, wherein the valve body (43) includes a lower extension protrusion wheel (431) fitted between the valve (422) and the upper extension piece (423), a blocking plate (432) protruding downward from a center of the valve body (43), a plurality of content discharge holes (433) formed on an outer peripheral surface of the blocking plate (432), and an upper extension protrusion wheel (434) formed on the lower extension protrusion wheel (431).

3. The gel-state content discharging applicator of claim 1, wherein a discharge member coupling protrusion wheel (61) to which a discharge member (70) is coupled is formed at an upper side of the outer container cap (60), a valve body coupling protrusion wheel (62) coupled to the valve body (43) is formed at a lower side of the outer container cap (60), and a cover (63) is formed outside the valve body coupling protrusion wheel (62).

4. The gel-state content discharging applicator of claim 1, wherein the pump main body (42) is integrally formed on an upper portion of the pump bottom plate (41), and includes an elastic support (421) formed of an elastic material in a cylindrical shape and a valve (422) formed of an elastic material and extending upward from the elastic support (421), an upper extension piece (423) formed outside the valve (422) while being spaced apart from the valve (422) by a predetermined interval, and a pump body horizontal extension piece (424) extending horizontally from an end of the upper extension piece (423).

5. A gel-state content discharging applicator comprising:

a container (10) including an inner container (11) having a content containing space (14) formed at an inside thereof and an outer container (12) formed outside the inner container (11);

a pressurization button (20) coupled to a lower end of the inner container (11) to move up and down within the outer container (12) together with the inner container (11);

a push plate (50) formed inside the content container (11);

an inner container cap (30) coupled to an upper side of the inner container (11) and formed on an upper portion thereof with a content suction hole (33);

a pump (40) installed on an upper portion of the inner container cap (30);

an outer container cap (60) coupled to an upper portion of the pump (40) and coupled to an upper side of the outer container (12); and a discharge member (70) coupled to an upper side of the outer container cap (60) and formed on an end thereof with a discharge port (71), wherein the pump (40) comprises a pump bottom plate (41), a pump main body (42) integrally extending from an upper side of the pump bottom plate (41), a valve body (43) coupled to an upper portion of the pump main body (42), and an elastic member (44) installed to an outside of the pump main body (42), wherein the inner container cap (30) includes an inner wall (31) extending downwardly, an outer wall (32) spaced apart from the inner wall (31) by a predetermined interval, the content suction hole (33) formed at the upper center, a pump receiving groove (34) formed on an outside of the content suction hole (33) and an upper wall (35) extending upward from an outside of the pump receiving groove (34).

6. The gel-state content discharging applicator of claim 5, wherein the valve body (43) includes a lower extension protrusion wheel (431) fitted between the valve (422) and the upper extension piece (423), a blocking plate (432) protruding downward from a center of the valve body (43), a plurality of content discharge holes (433) formed on an outer peripheral surface of the blocking plate (432), and an upper extension protrusion wheel (434) formed on the lower extension protrusion wheel (431).

7. The gel-state content discharging applicator of claim 5, wherein a discharge member coupling protrusion wheel (61) to which a discharge member (70) is coupled is formed at an upper side of the outer container cap (60), a valve body coupling protrusion wheel (62) coupled to the valve body (43) is formed at a lower side of the outer container cap (60), and a cover (63) is formed outside the valve body coupling protrusion wheel (62).

8. The gel-state content discharging applicator of claim 5, wherein the pump main body (42) is integrally formed on an upper portion of the pump bottom plate (41), and includes an elastic support (421) formed of an elastic material in a cylindrical shape and a valve (422) formed of an elastic material and extending upward from the elastic support (421), an upper extension piece (423) formed outside the valve (422) while being spaced apart from the valve (422) by a predetermined interval, and a pump body horizontal extension piece (424) extending horizontally from an end of the upper extension piece (423).

9. A gel-state content discharging applicator comprising:

a container (10) including an inner container (11) having a content containing space (14) formed at an inside thereof and an outer container (12) formed outside the inner container (11);

a pressurization button (20) coupled to a lower end of the inner container (11) to move up and down within the outer container (12) together with the inner container (11);

a push plate (50) formed inside the content container (11);

an inner container cap (30) coupled to an upper side of the inner container (11) and formed on an upper portion thereof with a content suction hole (33);

a pump (40) installed on an upper portion of the inner container cap (30);

an outer container cap (60) coupled to an upper portion of the pump (40) and coupled to an upper side of the outer container (12); and a discharge member (70) coupled to an upper side of the outer container cap (60) and formed on an end thereof with a discharge port (71), wherein the pump (40) comprises a pump bottom plate (41), a pump main body (42) integrally extending from an upper side of the pump bottom plate (41), a valve body (43) coupled to an upper portion of the pump main body (42), and an elastic member (44) installed to an outside of the pump main body (42), wherein a suction valve (411) for selectively blocking the content suction hole (33) of the inner container cap (30) is formed at a center of a lower surface of the pump bottom plate (41), a pump receiving protrusion (412) inserted into the pump receiving groove (34) is formed at an outside of the suction valve (411), and a pump bottom plate horizontal extending piece (413) extends from an outside of the pump receiving protrusion (412).

10. The gel-state content discharging applicator of claim 9, wherein the valve body (43) includes a lower extension protrusion wheel (431) fitted between the valve (422) and the upper extension piece (423), a blocking plate (432) protruding downward from a center of the valve body (43), a plurality of content discharge holes (433) formed on an outer peripheral surface of the blocking plate (432), and an upper extension protrusion wheel (434) formed on the lower extension protrusion wheel (431).

11. The gel-state content discharging applicator of claim 9, wherein a discharge member coupling protrusion wheel (61) to which a discharge member (70) is coupled is formed at an upper side of the outer container cap (60), a valve body coupling protrusion wheel (62) coupled to the valve body (43) is formed at a lower side of the outer container cap (60), and a cover (63) is formed outside the valve body coupling protrusion wheel (62).

12. The gel-state content discharging applicator of claim 9, wherein the pump main body (42) is integrally formed on an upper portion of the pump bottom plate (41), and includes an elastic support (421) formed of an elastic material in a cylindrical shape and a valve (422) formed of an elastic material and extending upward from the elastic support (421), an upper extension piece (423) formed outside the valve (422) while being spaced apart from the valve (422) by a predetermined interval, and a pump body horizontal extension piece (424) extending horizontally from an end of the upper extension piece (423).

* * * * *